US006159044A

United States Patent [19]

Kita

[11] Patent Number: 6,159,044

[45] Date of Patent: Dec. 12, 2000

[54] MOUNTING FOR AN ELECTRICAL CONNECTION BOX

[75] Inventor: Yukinori Kita, Yokkaichi, Japan

[73] Assignee: Sumitomo Wiring Systems, Ltd., Yokkaichi, Japan

[21] Appl. No.: 09/332,989

[22] Filed: Jun. 15, 1999

[30] Foreign Application Priority Data

Jun. 19, 1998 [JP] Japan ..... 10-173406

[51] Int. Cl.[7] ..... H01R 13/60

[52] U.S. Cl. ..... 439/570

[58] Field of Search ..... 439/569, 570, 439/573, 574, 564; 403/377, 408.1

[56] References Cited

U.S. PATENT DOCUMENTS

| | | | |
|---|---|---|---|
| 3,346,286 | 10/1967 | Wescott | 434/569 |
| 4,921,433 | 5/1990 | Biren | 439/569 |
| 4,941,769 | 7/1990 | Natsume | 403/408 |
| 5,178,557 | 1/1993 | Hashiguchi | 439/570 |
| 5,405,035 | 4/1995 | Kato | 220/3.8 |
| 5,532,431 | 7/1996 | Saka et al. | 174/52.3 |
| 5,622,519 | 4/1997 | Bixler et al. | 439/570 |

FOREIGN PATENT DOCUMENTS 6351127 12/1994 Japan .

*Primary Examiner*—Hien Vu
*Attorney, Agent, or Firm*—Greenblum & Bernstien, P.L.C.

[57] ABSTRACT

An electrical connection box is provided that is capable of positively preventing improper connections. A mounting area is formed on a side wall of an electrical connection box. On the mounting area, a generally U-shaped bolt housing recess is provided. At the deepest area, or closed end, of the bolt housing recess, a bolt is inserted, extends through a washer, and is fastened with a nut. An upwardly extending protrusion is formed at the open end of the bolt housing recess on the mounting area. The protrusion is so formed that, in tightening the bolt and nut at the deepest area, or closed end, of the bolt housing recess, the protrusion does not interfere with the washer. In addition, the height of the protrusion is set in such a manner that it is higher than a protruding height of the bolt in a condition in which the bolt is inserted in the bolt housing recess.

7 Claims, 4 Drawing Sheets

(a)

(b)

(a)

(b)

(PRIOR ART)

MOUNTING FOR AN ELECTRICAL CONNECTION BOX

BACKGROUND OF THE INVENTION

1. Field of the Invention

The present invention relates to a mounting for an electrical connection box which is to be mounted in an automatic vehicle.

2. Description of the Related Art

An electrical connection box has been used for housing electric equipment components such as various electric equipment circuits and electronic components used for automobiles, as well as for connecting junctions for wiring parts of a wire harness of the like.

Normally, an electrical connection box is fastened to a vehicle by use of tightening member such as bolts and nuts. Therefore, the electrical connection box is equipped with a mounting area provided for such fastening.

The conventional electrical connection box equipped with such mounting areas are hereinafter explained with reference to FIG. 7. A mounting area 52 is provided with a generally U-shaped bolt housing recess 53. That is, one end of the bolt housing recess 53 is open, thus making it easy to carry out mounting by slidably mounting from this opened area when inserting a bolt 54 into the bolt housing recess 53 which is provided on a vehicle frame 55.

When the bolt 54 is inserted into the bolt housing recess 53, a nut 56 is fastened to the bolt 54 through a washer 57. Therefore, the mounting area 52 and vehicle frame 55 are jointly connected, and thus the electrical connection box 51 is mounted on the vehicle.

As shown in FIG. 8(*a*), taking as a normal connection position, a position onto which the bolt is inserted into the deepest area of the bolt housing recess 53, the bolt 54 and nut 56 are tightened in this normal connection position. However, since the bolt housing recess 53 is open at one end, there has been the possibility that the mounting area 56 may be separated from the bolt 54 when the nut 56 is loosened due to vibration during operation of the vehicle.

In addition, the bolt housing recess 53 is provided to have a generally U-shape, having a certain distance from the open end thereof to the normal tightening position. Therefore, when tightening the bolt 54 and nut 56 at the normal tightening position, there has often been such connection at a position (an abnormal tightening area position) as shown in FIG. 8(*b*) other than the normal tightening position as shown in FIG. 8(*a*) with the electrical connection box 51 being displaced by a tightening force of the nut 56. In addition, in case of tightening at the abnormal tightening position, there has been deformation and damage to the mounting area 52 due to an excessive tightening torque resulting from a position at which an abnormally high face pressure exists between the washer 57 and the mounting area 52.

The present invention was made in view of the above circumstances, and the object of the present invention is to provide an electrical connection box capable of positively preventing such improper fastening.

SUMMARY OF THE INVENTION

In order to solve the above-mentioned objective according to a first aspect of the present invention, an electrical connection box having a mounting area is provided with a housing recess capable of receiving a tightening member from open end thereof, and the tightening member is fastened at its mounting area. The mounting area is provided with a fastening area controlling device to control the fastening position of the above-mentioned fastening members.

In another aspect of the present invention, the fastening position control device includes a protrusion provided at the open end of the bolt housing recess in the mounting area of the electrical connection box.

In accordance with the present invention, a further aspect of the protrusion is configured to be higher than a protruding height of the fastening member upon insertion into the bolt housing recess in the electrical connection box.

In a still further aspect of the present invention, the protrusion has on its upper surface an inclined surface which is inclined downwardly toward the deeper area, or closed end, of the bolt housing recess in the electrical connection box.

According to another aspect of the present invention, the fastening position control device includes a protrusion provided on at least one inner wall surface of the bolt housing recess in the electrical connection box.

DETAILED DESCRIPTION OF THE PREFERRED EMBODIMENTS

Figure 1:
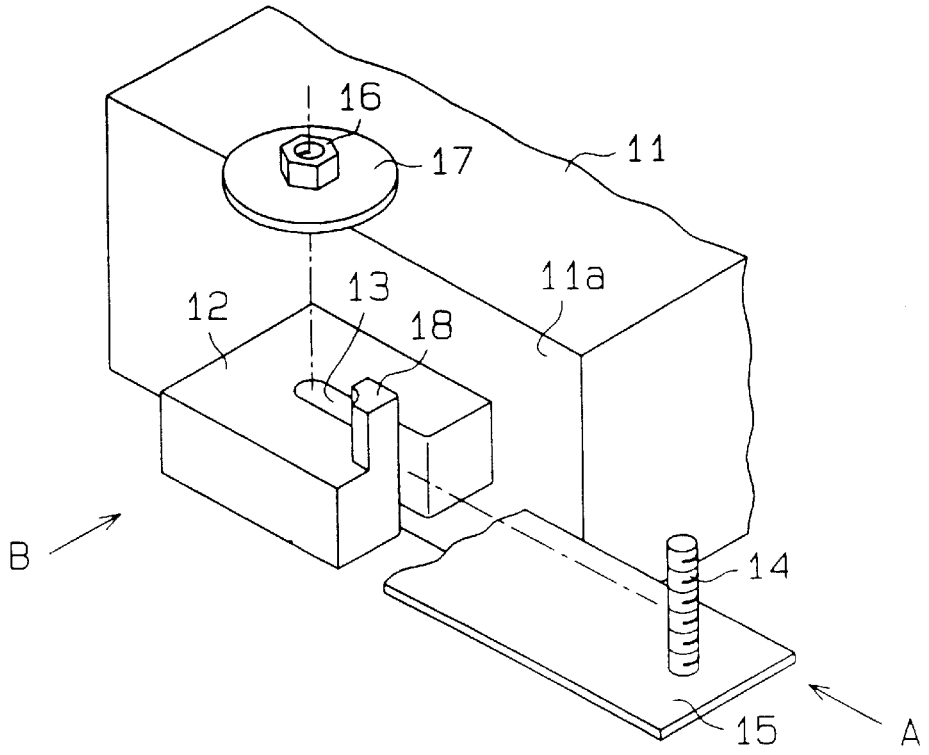
FIG. 1 is a partial perspective view showing a portion of a first embodiment of the electrical connection box of the present invention.
Figure 3:
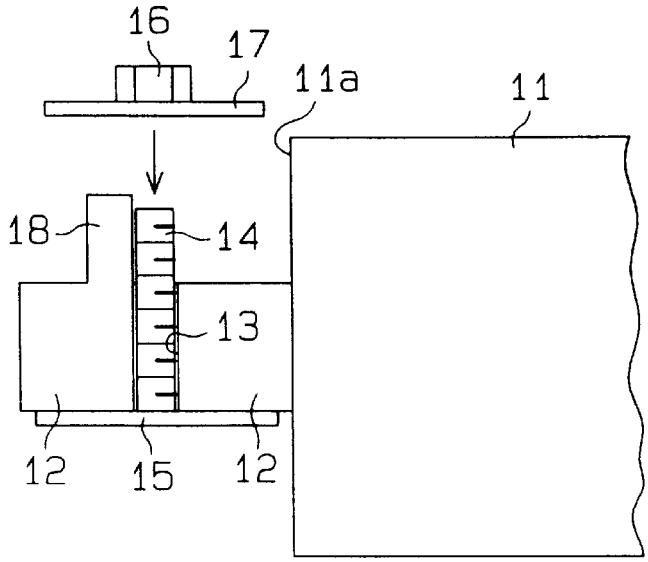
FIG. 3 is a side view showing a fastening mode of the first embodiment as seen from the direction of the arrow A in FIG. 1.

A first embodiment of the present invention is described below with reference to FIG. 1 and FIG. 3 of the drawings. As shown in FIG. 1, a mounting area 12 formed of a synthetic resin is provided on a side wall 11*a* in an electrical connection box 11. On the mounting area 12, a bolt housing recess 13 having a generally U-shape is provided. That is, one side of the bolt housing recess 13 has an open end, thus making it easy to carry out a mounting operation by slidably mounting from the open end when mounting the bolt housing recess 13 onto a bolt 14 which is provided on a vehicle frame 15. The bolt 14 inserted into the housing recess 13 is fastened with a nut 16 and a washer 17.

Figure 2:
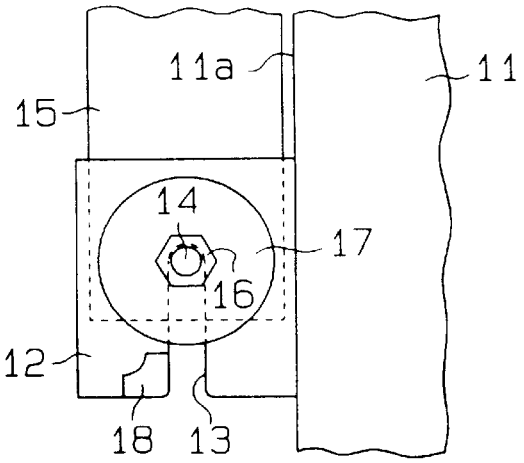
FIGS. 2(*a*) and (*b*) are plan views showing a fastening mode of the first embodiment.
Figure 2:
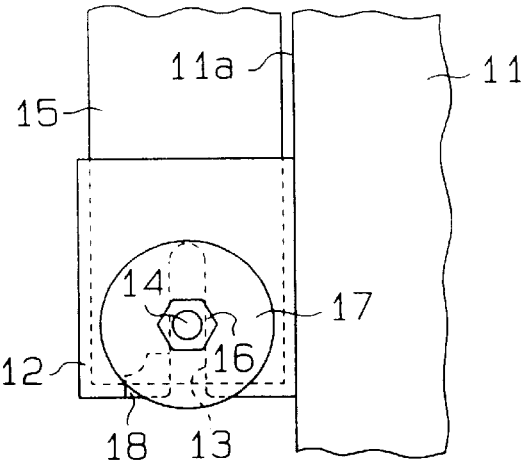

On the other hand, on the edge of the opening of the bolt housing recess 13 in the mounting area 12, a protrusion 18 is provided which extends upwardly. This protrusion 18 is, as shown in FIG. 2(*a*), formed at a position at which no interference is made with the washer 17 when the bolt 14 and nut 16 are mounted at the deepest area, or closed end, of the bolt housing recess 13. Furthermore, as shown in FIG. 3, the height of the protrusion 18 is provided in such a manner that it is higher than the height of the bolt 14 when the bolt 14 is inserted into the bolt housing recess 13.

In mounting an electrical connection box 11 thus constructed on the inside of a vehicle, first the bolt 14 is provided on a vehicle frame 15 and is inserted into a bolt housing recess 13 as shown in FIG. 2(*a*). Then, by positioning the bolt 14 into the deepest area of the bolt housing recess 13 (corresponding to the normal fastening position as shown in the preceding FIG. 8(*a*)), the nut 16 is threaded onto the bolt 14 which protrudes from a mounting area 12 and through the washer 17, as jointly shown in FIG. 3. Therefore, the mounting area 12 and the vehicle frame 15 are fastened together by joining the bolt 14 and nut 16. Thus, the electrical connection box 11 is fastened to the vehicle.

Figure 8:
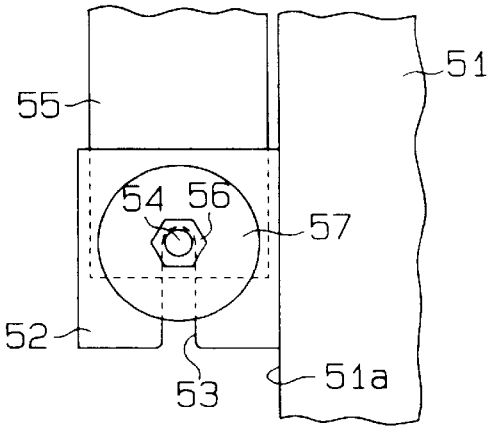
FIGS. 8(*a*) and (*b*) are plan views showing a fastening mode of the conventional electrical connection box.
Figure 8:
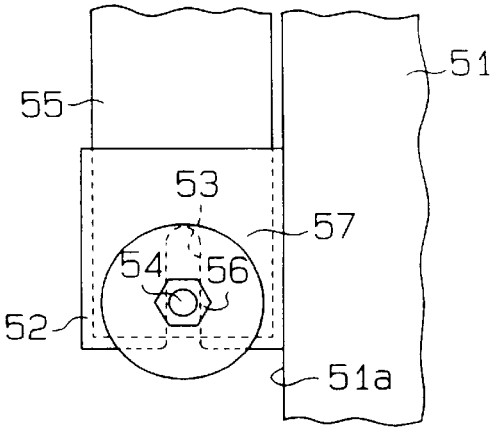
(PRIOR ART) Fig. 8

Furthermore, when fastening the bolt 14 and a nut 16, in the event the bolt 14 is located near the open end of the bolt housing 13, as shown in FIG. 2(*b*), the washer 17 interferes with a protrusion 18 (corresponding to the position of improper fastening as shown in the preceding FIG. 8(*b*)). Therefore, with such an improper fastening position, joining of the bolt 14 and the nut 15 becomes difficult, and the fastening position is controlled by the protrusion 18. Therefore, the bolt and nut can only be positively fastened together at the normal fastening position, thereby protecting against improper fastening between the bolt 14 and nut 16.

In addition, because the height of protrusion 18 is provided in such a manner that it is higher than the protruding height of the bolt 14 once inserted inside the bolt housing recess 13, in case of the above-mentioned improper fastening position, it becomes impossible to screw the nut 16 onto the bolt 14. Therefore, with fastening occurring between bolt 14 and nut 16 at the normal fastening position, any deformation and damage to the protrusion 18 can be avoided before hand.

Moreover, after the bolt 14 and nut 16 have been screwed together, even if the connection is loosened due to vibration and the like during operation of the vehicle, possible separation of the mounting area 12 from the bolt 14 can be prevented and properly controlled, because the washer 17 will be engaged by the protrusion 18.

As explained in detail above, the following results can be obtained in accordance with the first embodiment:

(1) In mounting an electrical connection box 11 on a vehicle, the fastening position between a bolt 14 and a nut 16 can be properly controlled by the protrusion 18, and an improper fastening between the bolt 14 and the nut 16 can positively be prevented.

(2) Because the height of the protrusion 18 is provided in such a manner that it is higher than a protruding height of the bolt 14 when the bolt 14 is inserted into the bolt housing recess 13, if the bolt 14 is located at an improper fastening position in the bolt housing recess 13, it becomes impossible to screw together the bolt 14 and the nut 16. Therefore, deformation and damage of the protrusion 18 caused by a tightening force between bolt 14 and the nut 16 can be prevented before hand.

(3) Even if the connection between the bolt 14 and nut 16 becomes loosened due to vibration and the like during operation of the vehicle, there will be no possibility of the mounting area 12 becoming separated from the bolt 14.

Figure 4:
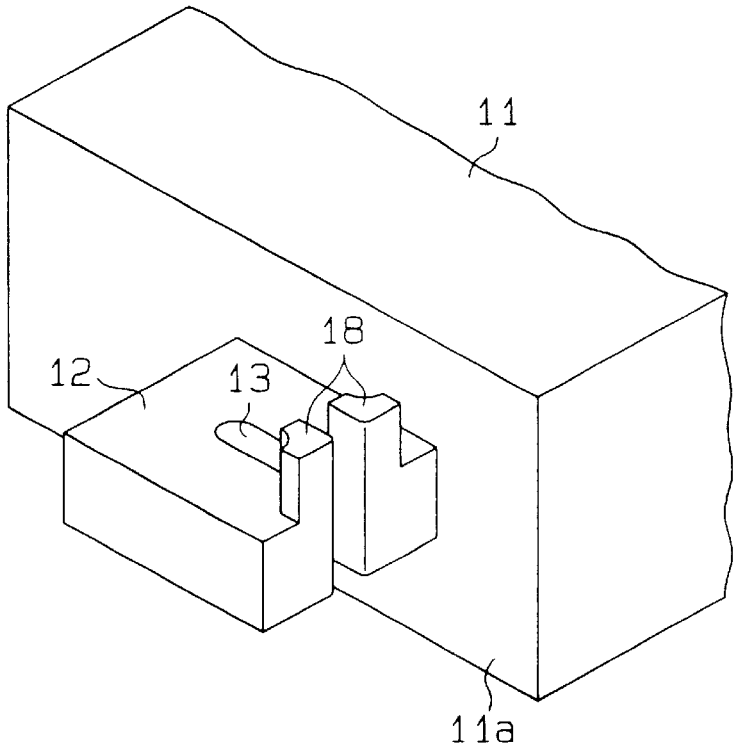
FIG. 4 is a partial perspective view showing a second embodiment of the electrical connection box of the present invention.

Furthermore, the first embodiment of the present invention may be modified in the following manner. According to the first embodiment, only one protrusion 18 was provided at the open end of the bolt housing recess 13 of the mounting area 12. However, in a second embodiment illustrated in FIG. 4, two sets of protrusions 18 are provided at the open end of the bolt housing recess.

Figure 5:
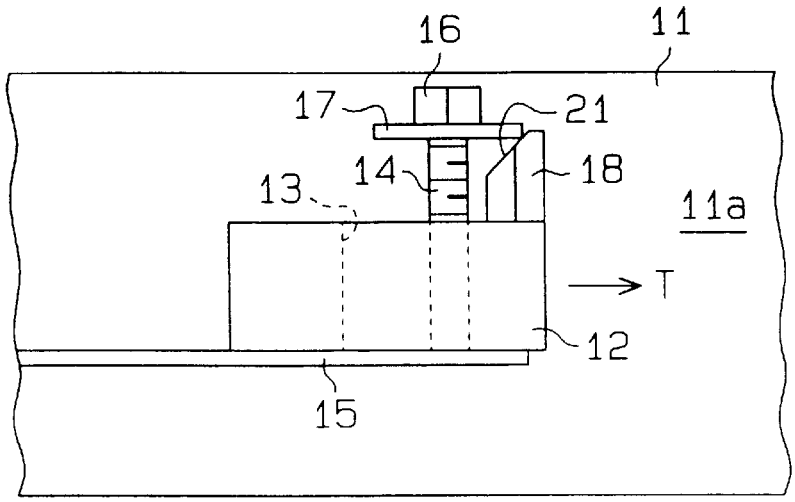
FIG. 5 is a front view showing a portion of a third embodiment of the electrical connection box of the present invention, as seen from the direction of the arrow B in FIG. 1.

According to a third embodiment as shown in FIG. 5, an inclined surface 21 which inclines downwardly toward the closed end of the bolt housing recess 13 is provided on the tip of the protrusion 18. In this way, when the bolt 14 and nut 16 are fastened at a position at which a washer 17 and the protrusion 18 interfere with one another, as shown in FIG. 5, the washer 17 slides along the inclined surface 21 as the nut 16 is screwed onto bolt 14. This causes the mounting area 12 to move in the direction shown by arrow T in FIG. 5, in accordance with the screwing of the nut 16 onto the bolt 14. Therefore, the bolt 14 and nut 16 become fastened at the normal fastening position at the completion of the fastening and it is not necessary to locate the fastening position with high precision, making it easy to carry out the fastening work.

Figure 6:
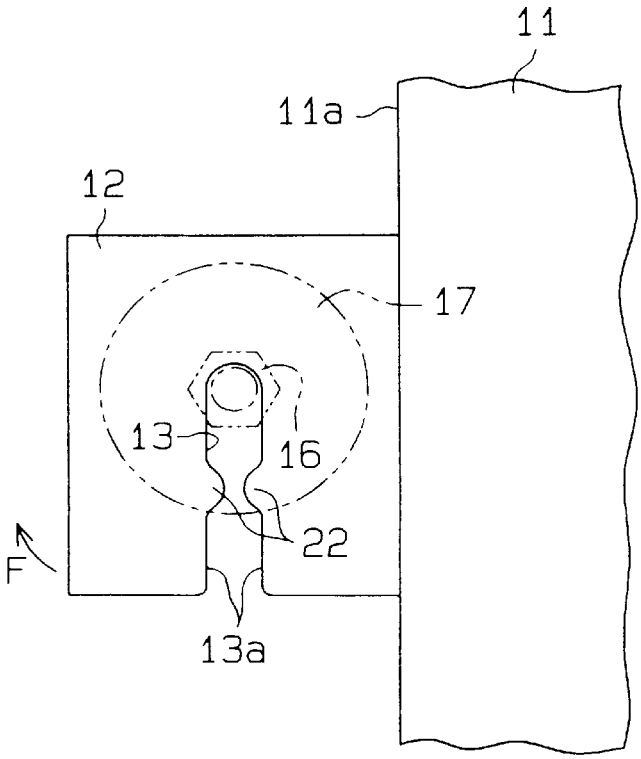
FIG. 6 is a partial plan view showing a portion of a fourth embodiment of the electrical connection box of the present invention.
Figure 7:
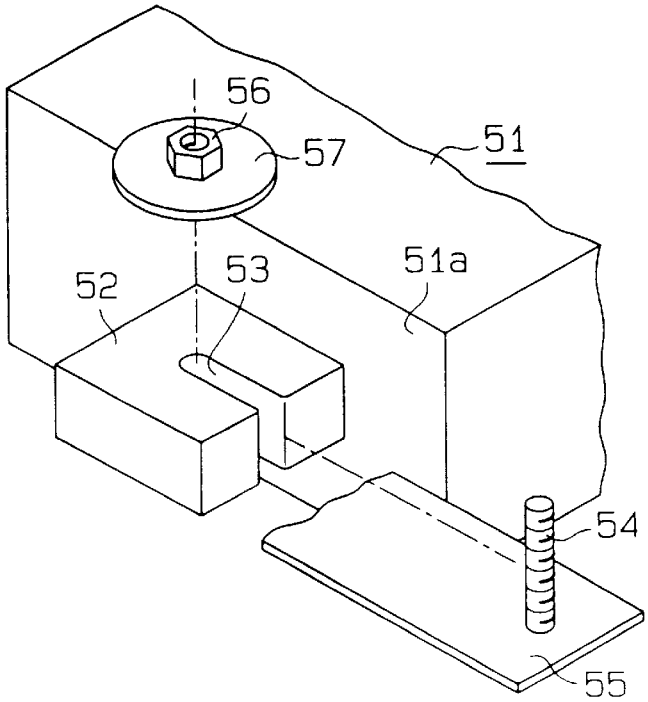
Fig. 7 (PRIOR ART)
FIG. 7 is a partial perspective view showing a portion of a conventional electrical connection box.

A protrusion 18 is provided on the open end of the bolt housing recess 13 in the mounting area 12 in order to control the fastening position between the bolt 14 and nut 16 in the preceding embodiments. However, as an alternative, a protrusion 22 is provided on both sides of the inner wall surface of the bolt housing recess 13 as shown in FIG. 6. In this embodiment, the bolt 14 will be caught by the protrusions 22 when inserting the bolt 14 from the open end of the bolt housing recess 13. Furthermore, the bolt 14 will deflect the mounting area 12 in a direction by the arrow F shown in FIG. 6, and will move beyond the protrusions 22, and then into the normal fastening position of the bolt housing recess 13. In this way, movement of the mounting area 12 against the bolt 14 is controlled, and fastening of the bolt 14 and nut 16 at an improper fastening position can be prevented. Additionally, after fastening between the bolt 14 and nut 16, even if the nut 16 may become loosened due to vibration during operation of the vehicle, separation of the mounting area 12 from the bolt 14 will not occur due to the bolt 14 being retained by the protrusions 22. In this case, the same result can be obtained even if only one protrusion 22 is provided on either one of the inside wall surfaces 13*a*.

In the preceding embodiments, a washer 17 is provided when the bolt 14 and nut 16 are fastened. Alternatively, washer 17 may be eliminated. In this way, the number of components can be reduced. However, it is preferable to locate the protrusion 18 at the deepest area where the protrusion 18 will not interfere with the nut 16, in the event a washer 17 is not utilized.

Although the bolt 14 has been described as being provided on the vehicle frame 15 in the preceding embodiments, the bolt 14 may also be provided separately from the vehicle frame 15. In this way, the vehicle frame 15 and the mounting area 12 are jointly fastened with the bolt 14 and the nut 16.

Description for each embodiment was made as mentioned above, and further description follows of the technical concept that can be obtained from each embodiment:

(1) With an electrical connection box according to one aspect of the present invention, an electrical connection box includes fastening members configured as nuts and bolts.

In this way, the fastening area and the object to be fastened by the bolt and nut can easily and positively be connected, making it possible to limit the proper fastening position to a predetermined position by a fastening position control device.

(2) With the electrical connection box according to another aspect of the present invention, an electrical connection box includes the above-mentioned fastening member and further includes a washer, with the above-mentioned nut being fastened with the above-mentioned bolt through the washer.

In this way, a face pressure acting on a mounting area caused by a tightening force from a bolt and nut can be distributed by a washer, thereby making it possible to properly control the force on the mounting area, thereby preventing deformation and change caused by an excessive tightening force.

According to another aspect of the present invention, a fastening position of fastening members can be controlled by a fastening position control device thereby avoiding improper fastening.

According to a further aspect of the present invention, interference occurs between fastening members and a protrusion, so that it is difficult to have the fastening members fastened at the edge of the opening on the housing concave area. Therefore, the fastening position of fastening members can be controlled, thereby preventing improper fastening.

According to yet another aspect of the present invention, fastening of the fastening members can be prevented at a position at which interference occurs with a protrusion, and possible deformation and damage can further be avoided in advance of the protrusion caused by fastening of the fastening members.

According to another aspect of the present invention, even when the fastening made for fastening members at a position at which interference is generated with a protrusion, it is possible to have the fastening members fastened at a deeper area of housing concave area. Therefore, a fastening position of the fastening member to the housing recess can easily be carried out.

Accordingly to a further aspect of the present invention, movement of mounting area can be controlled for fastening members when fastening the fastening members, thereby preventing possible improper fastening.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

The present disclosure relates to subject matter contained in priority Japanese Application No. HEI 10-173406, filed on Jun. 19, 1998, which is herein expressly incorporated by reference in its entirety.

What is claimed is:

1. An electrical connection box including a mounting area having a housing recess configured to receive a securing member from an open end of said recess, the securing member being attached to a frame member and receiving a separable fastening member, the fastening member being configured to engage against the mounting area to fix said electrical connection box in position relative to the securing member, said mounting area comprising:

a position controlling device provided adjacent the open end of said housing recess of said mounting area to control a fastening position of the securing member by engagement with one of the fastening member and the securing member.

2. An electrical connection box as set forth in claim 1, wherein said position controlling device includes at least one protrusion.

3. An electrical connection box as set forth in claim 2, wherein:

said at least one protrusion has an inclined area which inclines downwardly toward a closed end of said housing recess.

4. An electrical connection box as set forth in claim 2, wherein:

said at least one protrusion is configured to extend to a position above a protruding height of the securing member to be fastened to said housing recess of said mounting area by the fastening member, said at least one protrusion engaging with the fastening member to control the fastening position of the securing member.

5. An electrical connection box as set forth in claim 4, wherein:

said at least one protrusion has an inclined area which inclines downwardly toward a closed end of the said housing recess.

6. An electrical connection box as set forth in claim 4, further comprising two of said protrusions, each said protrusion positioned on an opposite side of said recess at the open end of the recess.

7. An electric connection box as set forth in claim 1, wherein said position controlling device comprises at least one protrusion provided on an inner wall surface of said housing recess that engages with the securing member to control the fastening position of the securing member.

* * * * *